US009815529B2

(12) United States Patent
Perkins

(10) Patent No.: US 9,815,529 B2
(45) Date of Patent: Nov. 14, 2017

(54) APPARATUS AND METHOD FOR BOARDING ANIMALS ONTO A BOAT

(71) Applicant: WAG PRODUCTS, LLC, Pewaukee, WI (US)

(72) Inventor: James M Perkins, Pewaukee, WI (US)

(73) Assignee: WAG Products, LLC, Pewaukee, WI (US)

( * ) Notice: Subject to any disclaimer, the term of this patent is extended or adjusted under 35 U.S.C. 154(b) by 0 days.

(21) Appl. No.: 13/735,784

(22) Filed: Jan. 7, 2013

(65) Prior Publication Data

US 2013/0247812 A1 Sep. 26, 2013

Related U.S. Application Data

(60) Provisional application No. 61/585,783, filed on Jan. 12, 2012.

(51) Int. Cl.

| | |
|---|---|
| ***B63B 27/14*** | (2006.01) |
| ***B63B 17/00*** | (2006.01) |
| ***E04H 4/14*** | (2006.01) |
| ***E06C 1/06*** | (2006.01) |
| ***E06C 7/18*** | (2006.01) |
| ***E06C 7/48*** | (2006.01) |

(52) U.S. Cl.

CPC ..... *B63B 27/14* (2013.01); *B63B 17/00* (2013.01); *E04H 4/144* (2013.01); *E06C 1/06* (2013.01); *E06C 7/188* (2013.01); *E06C 7/48* (2013.01)

(58) Field of Classification Search

CPC ..... B63B 17/00; B63B 27/14; B63B 27/146; E06C 1/34; E06C 1/36; E06C 7/188; E04H 4/144

USPC ..... 182/97, 93, 127, 214, 229, 197, 107, 95; 114/362

See application file for complete search history.

(56) References Cited

U.S. PATENT DOCUMENTS

| | | | | |
|---|---|---|---|---|
| 146,274 | A | | 1/1874 | Parent |
| 2,140,828 | A | * | 12/1938 | Carle ..... 248/238 |
| 2,485,413 | A | * | 10/1949 | Ross ..... 182/214 |
| 2,536,966 | A | | 1/1951 | Teller |
| 2,876,047 | A | | 3/1959 | La Plante |
| 3,159,141 | A | | 12/1964 | Paterek |
| 3,498,410 | A | * | 3/1970 | Storch ..... 182/96 |
| 3,503,468 | A | | 3/1970 | Taylor, Sr. |
| 3,603,431 | A | * | 9/1971 | Nameche et al. ..... 182/206 |
| 3,891,053 | A | | 6/1975 | Burton |
| 4,186,820 | A | * | 2/1980 | Cosman ..... 182/93 |
| 4,241,807 | A | | 12/1980 | McKenna et al. |
| 4,293,967 | A | | 10/1981 | Ord |
| 4,538,314 | A | * | 9/1985 | Baranowski ..... 14/71.1 |
| 4,722,420 | A | | 2/1988 | Arthurs et al. |

(Continued)

FOREIGN PATENT DOCUMENTS

DE 4306733 A1 9/1994

*Primary Examiner* — Colleen M Chavchavadze
(74) *Attorney, Agent, or Firm* — Ryan Kromholz & Manion, S.C.

(57) ABSTRACT

Disclosed is a boarding apparatus for boarding animals onto a boat or other above-water surface, and methods of using the apparatus. The apparatus has a boarding step assembly, a mounting assembly attached to the boarding step assembly for connecting the step assembly to a boat hull gunwale or transom lip, and a strut assembly for supporting the engagement of the boarding step assembly to the boat hull.

14 Claims, 5 Drawing Sheets

(56) References Cited

U.S. PATENT DOCUMENTS

| | | | | |
|---|---|---|---|---|
| 4,724,925 | A * | 2/1988 | Ritten | 182/97 |
| 4,907,673 | A | 3/1990 | Ginter et al. | |
| 4,989,691 | A | 2/1991 | Wilkerson et al. | |
| 4,998,982 | A | 3/1991 | Arnold et al. | |
| 5,515,806 | A | 5/1996 | McCabe | |
| 5,592,801 | A | 1/1997 | Balzer | |
| 5,829,380 | A | 11/1998 | Smith | |
| 5,887,540 | A * | 3/1999 | Krish, Jr. | 114/362 |
| 6,058,875 | A * | 5/2000 | Krish, Jr. | 114/362 |
| D440,717 | S | 4/2001 | Fazio | |
| 6,250,424 | B1 * | 6/2001 | Laug | 182/107 |
| 6,267,082 | B1 | 7/2001 | Naragon et al. | |
| 6,401,861 | B1 | 6/2002 | Marszalek | |
| 6,578,510 | B1 | 6/2003 | Scruggs et al. | |
| 6,598,562 | B1 | 7/2003 | Dutkiewicz et al. | |
| 6,941,823 | B1 | 9/2005 | Lai et al. | |
| 6,941,889 | B1 * | 9/2005 | McCrocklin et al. | 114/362 |
| 6,948,588 | B1 * | 9/2005 | Chustak | 182/97 |
| 6,983,823 | B1 | 1/2006 | Zumbrunnen | |
| 7,011,036 | B1 * | 3/2006 | Hill | 114/362 |
| 7,017,709 | B1 * | 3/2006 | Laymance | 182/97 |
| 7,090,049 | B2 * | 8/2006 | Adair | 182/97 |
| 7,134,525 | B1 * | 11/2006 | Ferris | 182/107 |
| 8,596,212 | B2 * | 12/2013 | Perkins | 114/362 |
| 2003/0106173 | A1 | 6/2003 | Miller | |
| 2006/0272895 | A1 | 12/2006 | Lavoie | |
| 2009/0107764 | A1 * | 4/2009 | Showalter | 182/165 |
| 2011/0226554 | A1 * | 9/2011 | Anderson | 182/222 |
| 2011/0253479 | A1 * | 10/2011 | Gandy | 182/107 |
| 2012/0175188 | A1 * | 7/2012 | Xu | 182/107 |

* cited by examiner

APPARATUS AND METHOD FOR BOARDING ANIMALS ONTO A BOAT

RELATED APPLICATION

This application claims the benefit of U.S. provisional application Ser. No. 61/585,783 filed 12 Jan. 2012.

BACKGROUND OF THE INVENTION

The present invention relates generally to an apparatus for accessing or boarding a surface standing at least partially in and above a water surface, such as boat, dock, landing, raft or other similar surfaces, and particularly to a step apparatus attachable to a portion of a surface standing at least partially in and above a water surface for boarding animals from the water onto the surface.

It is common for animals to accompany their owners on boat trips. During these trips, the human owners, as well as the animals, may choose to enter the water. Reboarding the boat, or accessing a raft, dock, or other surface from the water is a challenge for many reasons, including forces by currents and waves, as well as lack of ground support on which to push off to re-board the boat or access the surface. This is especially difficult for animals, such as dogs, that cannot make use of the boat or dock ladder, if present, that is designed to assist humans. Furthermore, animals, such as dogs, are unable to pull themselves up onto the boat or dock as humans can. Therefore, it is often the owners themselves who have the difficult task of retrieving their animal from the water. Not only is this a challenge, but it also involves getting wet and is potentially dangerous for both the humans and the animals.

As such, there is a need for a boarding device to assist animals, such as dogs, onto the boat, dock, or other surface from the surrounding water. Such devices are presently available for use on boats, but these devices are unstable, unable to attach to different boat hull designs, may be difficult to configure for use and transport, may be difficult to attach or detach, and requires awkward or uncomfortable animal positions.

In addition, the design of many prior devices makes those devices susceptible to high external forces. The external forces are due to the high surface area of the devices in the planes of the water movement and may cause high degrees of movement relative to the boat hull or other above-water surface. This can be intimidating to the animal and may discourage use. This movement can also result in damage to the boat hull or surface, and/or damage to the boarding apparatus, with the potential for injuring the animal. Thus, there remains a need for a stable, pet-friendly, simple, and universally adaptable animal boarding apparatus, with a design that minimizes the presence and effect of external forces, and conforms to various hull constructions.

SUMMARY OF THE INVENTION

In view of these drawbacks, the present invention is a boat boarding apparatus for animals, such as dogs, designed to attach to a boat hull gunwale or transom lip. The apparatus may also be mountable to docks, rafts, swimming pools, and other structures associated with water; however, to provide spatial arrangement of the invention, discussion of the apparatus will focus on its mountability to a boat hull gunwale or transom lip. The apparatus comprises a boat boarding step assembly, a boat hull mounting assembly attached to the boarding step assembly for connecting the boarding step assembly to the boat hull gunwale or transom lip, and a set of strut assemblies for providing additional support to said boat hull. The mounting assembly provides positive engagement with the boat hull lip via clamping forces.

Another feature of the apparatus of the present invention is that the apparatus is generally adaptable to any existing boat hull design. The boarding step assembly of the apparatus preferably comprises at least a pair of parallel runners and a plurality of spaced platforms spanning the space between the parallel runners, forming the steps.

The mounting assembly is preferably attached to each of the parallel runners, preferably at the top of the set of steps. The mounting assembly is configured to attach to an existing boat hull lip by a clamping force. In one embodiment of the invention, the mounting assembly comprises a pair of mounting brackets and hooks, one at the top of each parallel runner, configured to clamp to the boat hull lip. The apparatus may further have a pair of independently mounted strut assemblies, one attached to each parallel runner, that extend to abut the boat hull, in order that once the strut assemblies are in the desired position, the apparatus remains stable while attached to the boat. Each of the strut assemblies is configured to translate both horizontally and vertically, independently of the other, to work with various boat hull shapes and sizes.

In one embodiment, the mounting assembly comprises a mounting bar spanning the space between the mounting brackets attached to the top of the parallel runners. The mounting bar can then be bolted or clamped to the boat, dock, or other above-water surface.

The present invention also minimizes the presence and effect of external forces due to its high open area in the x, y, and z planes, created by apertures in the parallel runners, the platforms forming the steps, and the open space between each platform. Additionally, the positive attachment by clamping force of this apparatus to the boat hull gunwale or transom lip also minimizes the movement of the steps relative to the boat when subjected to these external forces.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention.

Often with certain types of boats, such as fishing or jon boats, or other shallow boats, the boat does not have a sufficient ladder structure for a boat boarding apparatus to engage, or possibly the boat is used in shallower waters where a boat boarding apparatus having an extended length is not feasible. The boarding apparatus 110 provides an arrangement that can address such boat configurations. While the apparatus is generally described with respect for use with a boat, it is understood that the present invention is capable of engaging other water based structures, such as docks, swimming pool edges, rafts, and similar structures.

Figure 1:
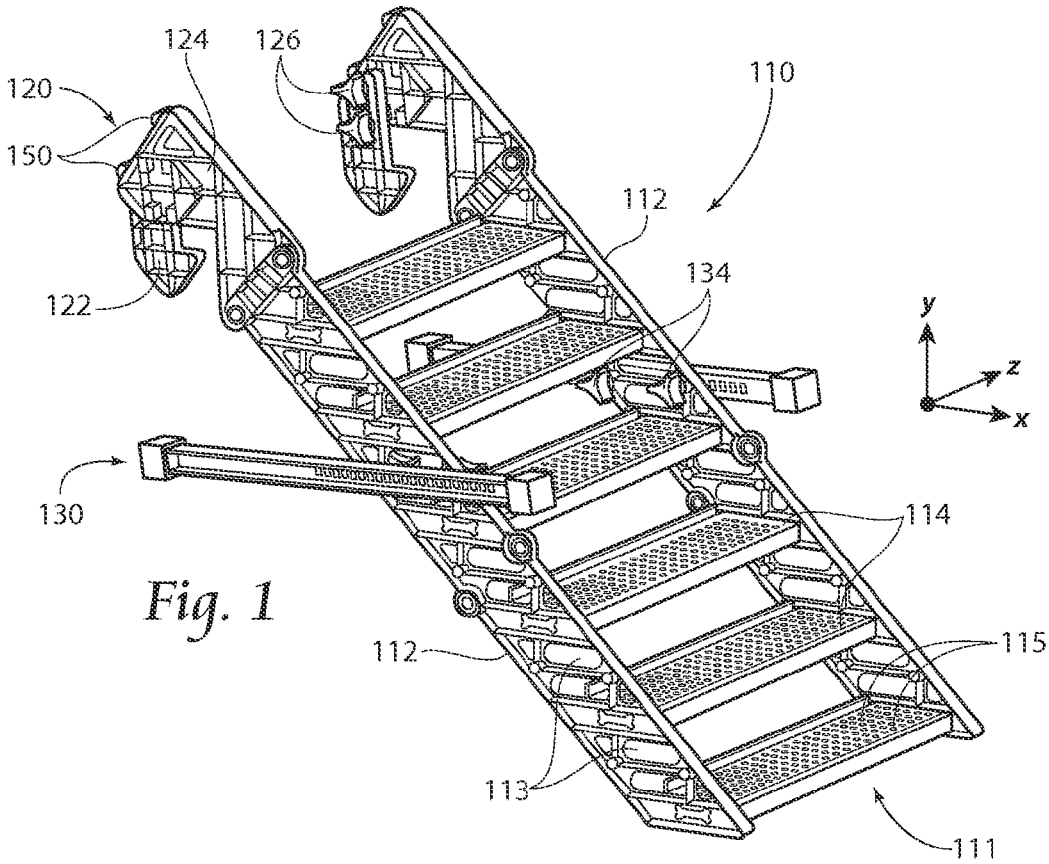
FIG. 1 is a top perspective view of a boarding apparatus for animals according to the present invention.
Figure 5:
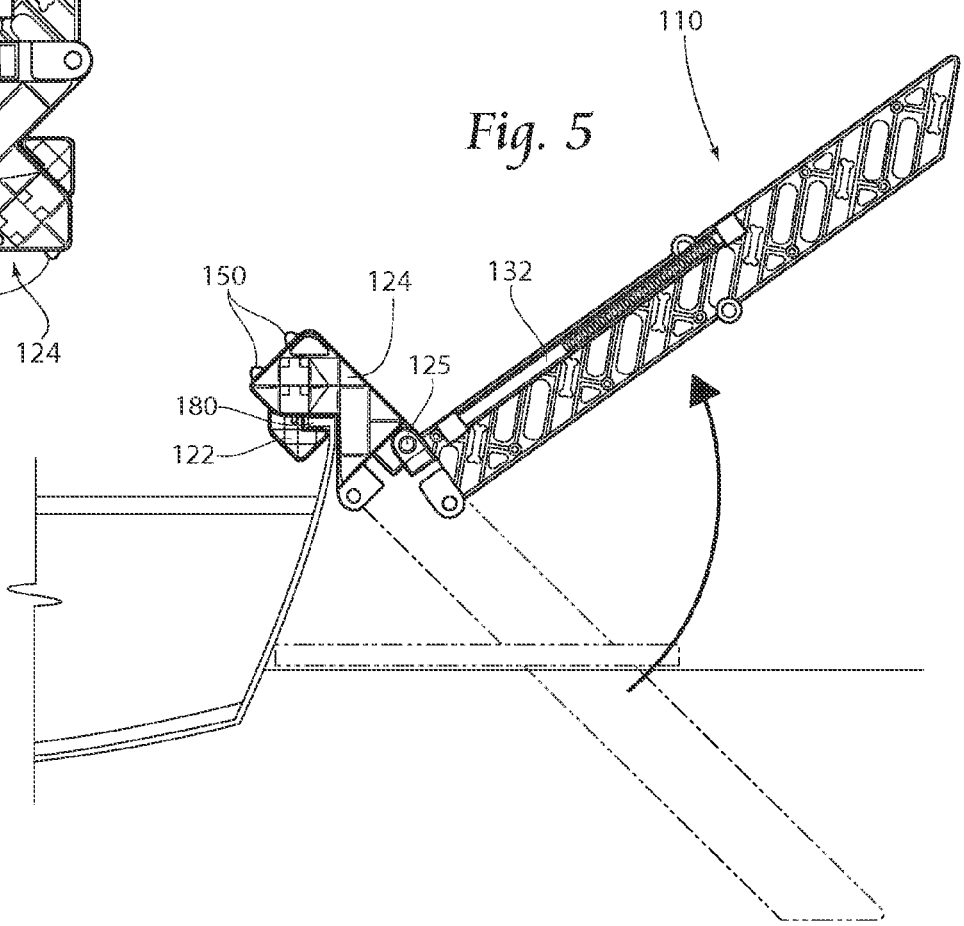
FIG. 5 is a side view of the apparatus demonstrating the rotatability of the runners relative to the mounting assembly while the apparatus remains attached to a boat hull.

FIG. 1 shows an embodiment of the present invention. A boarding apparatus 110 for animals, such as dogs, is shown and described. The apparatus 110 is configured to attach to the existing boat hull gunwale or transom lip 180 of a boat 5, as shown in FIG. 5. The apparatus 110 comprises a boarding step assembly 111. The boarding step assembly 111 can be of any shape or form that will assist an animal in boarding a boat from the water.

Still referring to FIG. 1, the step assembly 111 preferably comprises at least two elongated runners 112 positioned parallel to one another. Parallel refers to arrangements that are parallel or are substantially parallel to one another. A plurality of flat platforms 114 are spaced apart perpendicularly along the length of the elongated runners 112. These platforms 114 make up the steps of the step assembly 111.

Another feature of the present invention is shown and described in FIG. 1. To limit stress and undue force on the apparatus from external forces, such as waves or wakes in the water, the runners 112 may be designed with a plurality of apertures 113 to increase the open area, and thus reduce external forces from the surrounding water on the apparatus 110 in the z-direction. Similarly, the platforms 114 may also include apertures 115 to increase the open area and reduce external forces in the y-direction. Similarly, the spaced apart configuration of the platforms 114 increases the open area and reduces external forces in the x-direction. This minimization of external forces is beneficial to minimize movement of the apparatus 110 with relation to the boat hull 190 and reduce potential for damage to the apparatus 110 and the boat 5.

Figure 2A:
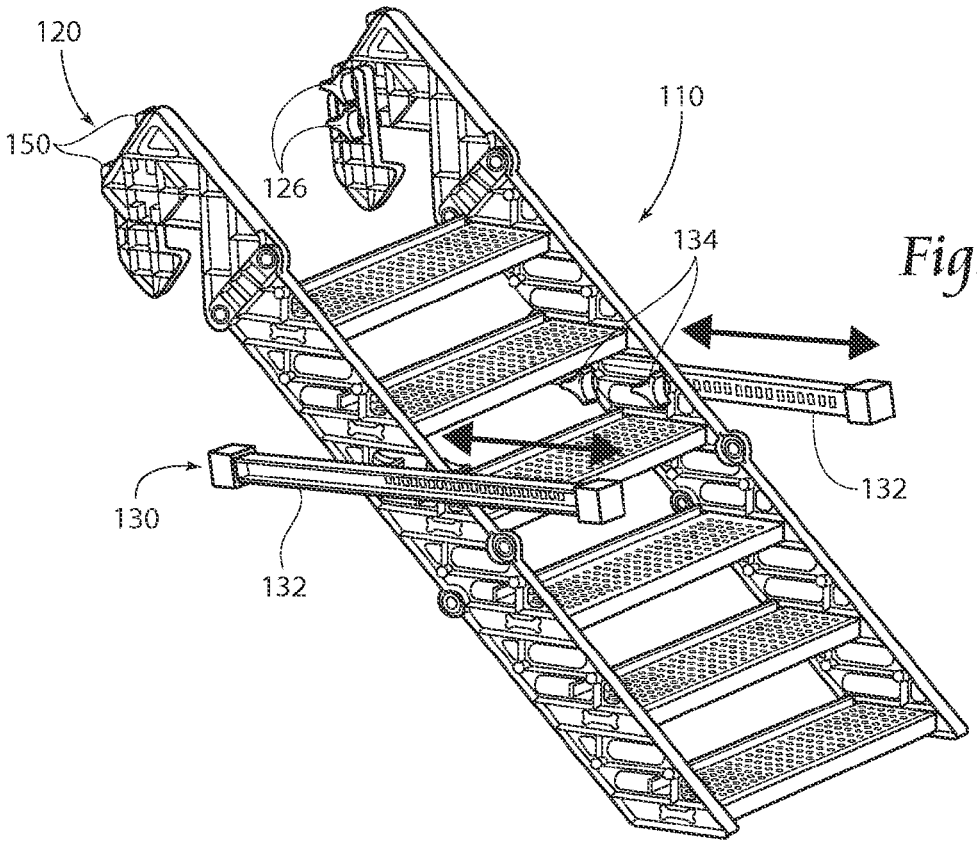
FIG. 2A is a top perspective view of the boarding apparatus of FIG. 1, with strut assemblies capable of being independently adjusted horizontally inwardly and outwardly.
Figure 2B:
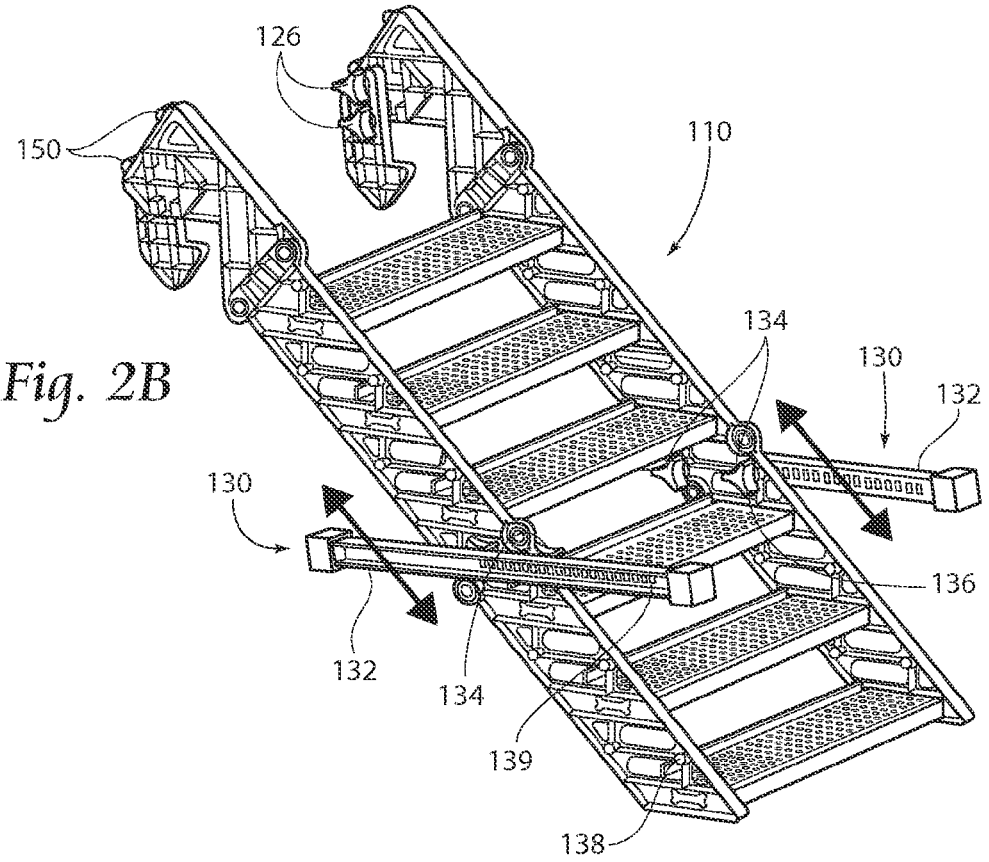
FIG. 2B is a top perspective view of the boarding apparatus, demonstrating the strut assemblies capable of being independently adjusted vertically with respect to the position of the strut assemblies of FIG. 2A.

The boat boarding apparatus 110 may also comprise a boat hull mounting assembly 120 and a strut mounting assembly 130. Referring to FIGS. 2A and 2B, the strut mounting assembly 130 comprises a pair of struts 132 and a securing mechanism 134. As shown in FIG. 2A, the struts 132 are attached to the runners 112 by a releasable securing mechanism 134. The securing mechanism 134 allows for the struts 132 to be independently adjusted inwardly and outwardly with respect to the apparatus 110 and the boat 5. As demonstrated in FIG. 2B, the struts may be adjusted vertically upwards or downwards, independent of one another, to provide the appropriate mounting angle with the boat hull 190. The arrangement of the strut assembly 130 allows the apparatus 110 to be positioned in various configurations so that it may be mounted at the desired angle regardless of the boat hull shape. It also allows the apparatus 110 to be in contact with the hull 190 in the area of maximum strength and rigidity. The strut assembly 130 may further include a connecting member between the struts 132 to distribute the force against the boat hull 190 (not shown).

Referring further to FIG. 2B, the securing mechanisms 134 are arranged to securely hold the struts 132 to the boarding steps 111. As stated, the preferred arrangement allows for the struts 132 to be individually adjusted and repositioned as needed, and any type of mechanism that would secure the struts 132 to the runners 112 would be within the scope of the present invention. The struts 132 are preferably removable as well, which assists in positioning and repositioning the apparatus 110, as well as storage of the apparatus. For example, a type of securing mechanism 134, as shown, would be a threaded fastener 136 that would intersect holes 138 located on the runners 112 and corresponding holes 140 located on the struts 132. The fasteners 136 may be secured in a threaded securing mechanism, such as by a wing nut on the opposing side. To release, the fasteners 136 can be rotatably loosened so that they are no longer intersecting the struts 132 permitting the strut assembly 130 to be repositioned as shown in FIGS. 2A and 2B. Other securing mechanisms 134 could be used, such as a pair of ball detent pins (not shown) placed through the holes 138 located in the runner 112 that interlock with holes 140 located in the struts 132. Provided that the securing mechanism allows for an adjustable arrangement of the strut assemblies 130 as discussed, it is understood that such a mechanism would remain within the scope of the present invention.

Figure 7:
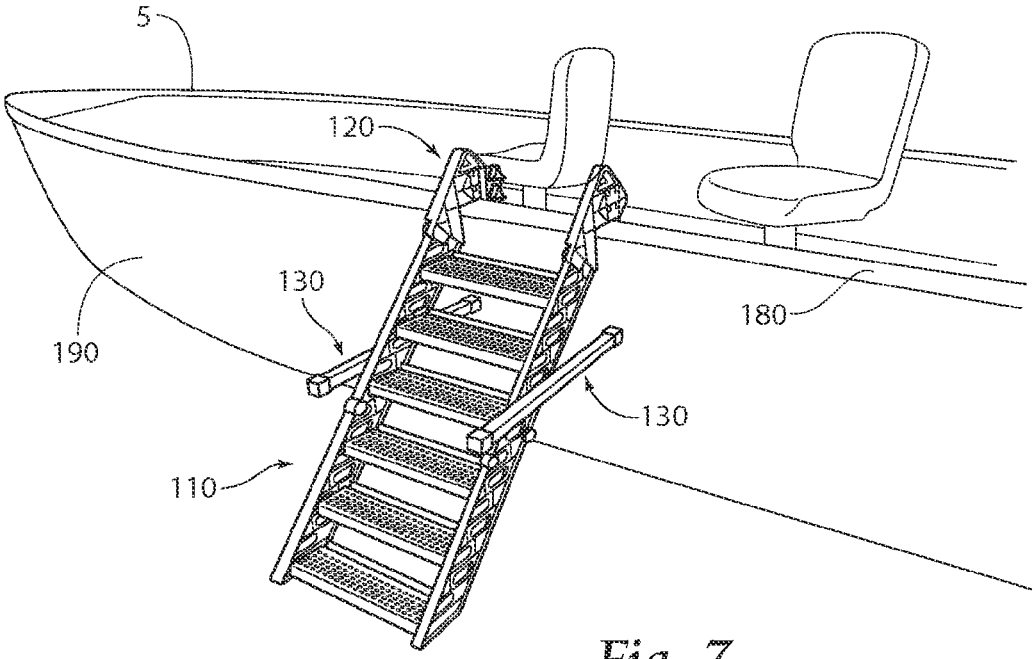
FIG. 7 is a perspective view of the apparatus of FIG. 1 being mounted on a boat hull.
Figure 8:
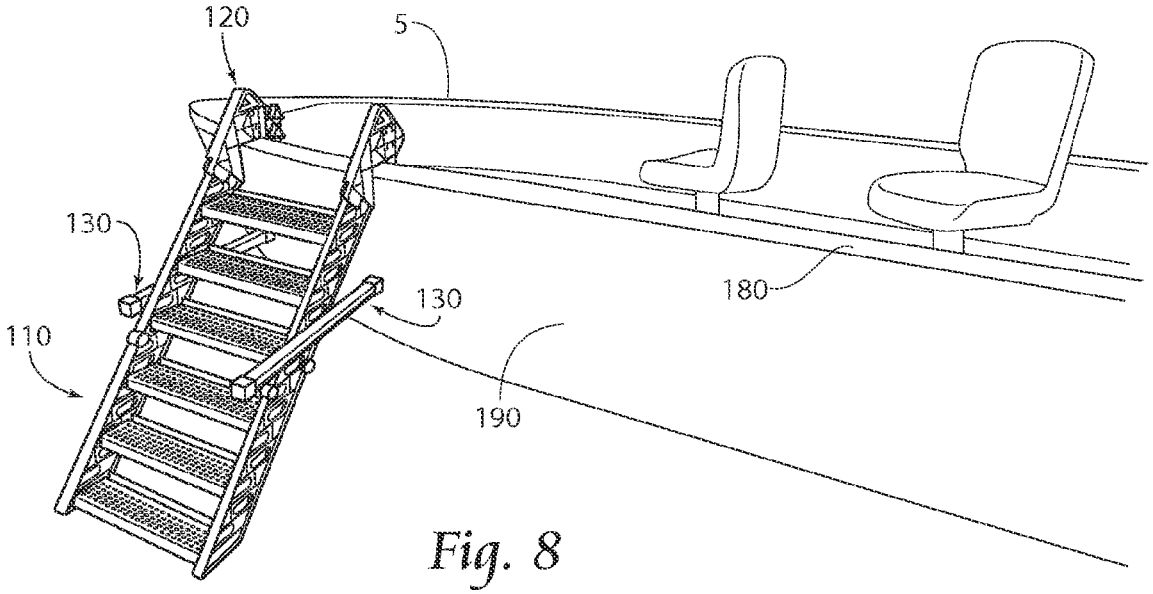
FIG. 8 is a perspective view of the apparatus of FIG. 1 being mounted on a boat in a second position.
Figure 9:
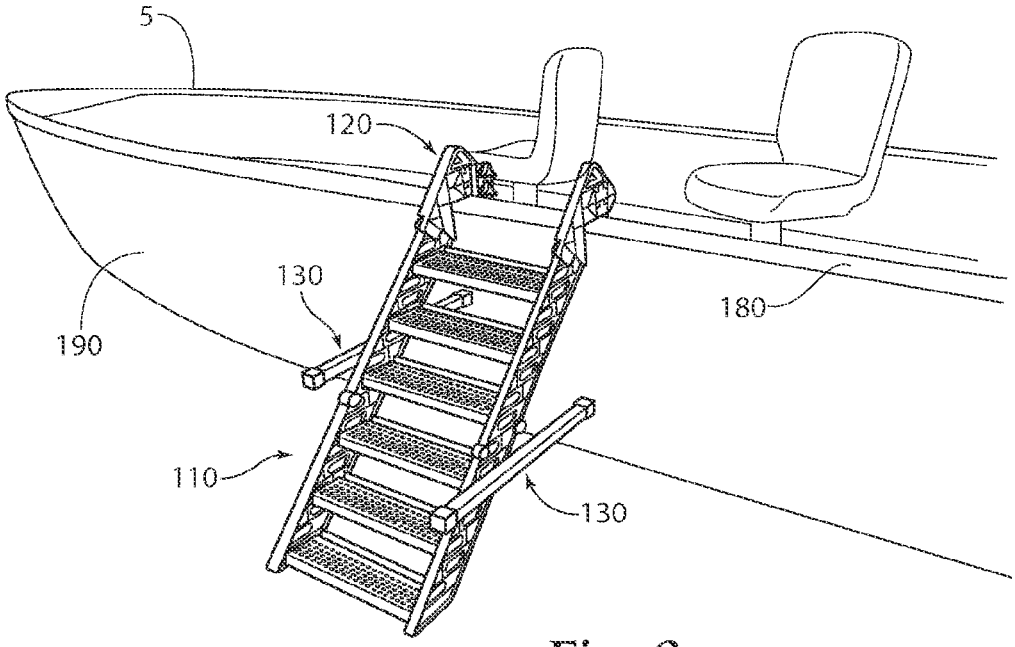
FIG. 9 is a perspective view of the apparatus of FIG. 1 being mounted on a boat in a third position.

As stated above, the apparatus 110 provides for various strut 132 positions to facilitate use in differing conditions and with many different boat hull designs. The struts 132 may be placed at various locations up and down the runners 112 in any of the holes 138, with each of the struts 132 being positioned independently at any of the vertical positions. As illustrated in FIGS. 7-9, the struts 132 may be positioned so that they better conform to the shape of the boat hull 190. In FIG. 7 the struts 132 are positioned equally away from the boat hull 190. However, as shown in FIG. 8, one of the struts 132 is positioned in a different inward position from the other in order to follow the curve in the boat hull 190. This adjustability and versatility provides for a more stable attachment to the boat hull 190 that is safer for both animal and animal owner, and less harmful to the boat. Such adjustment could also allow for one of the struts 132 to be positioned horizontally one above the other, as shown in FIG. 9.

Figure 3:
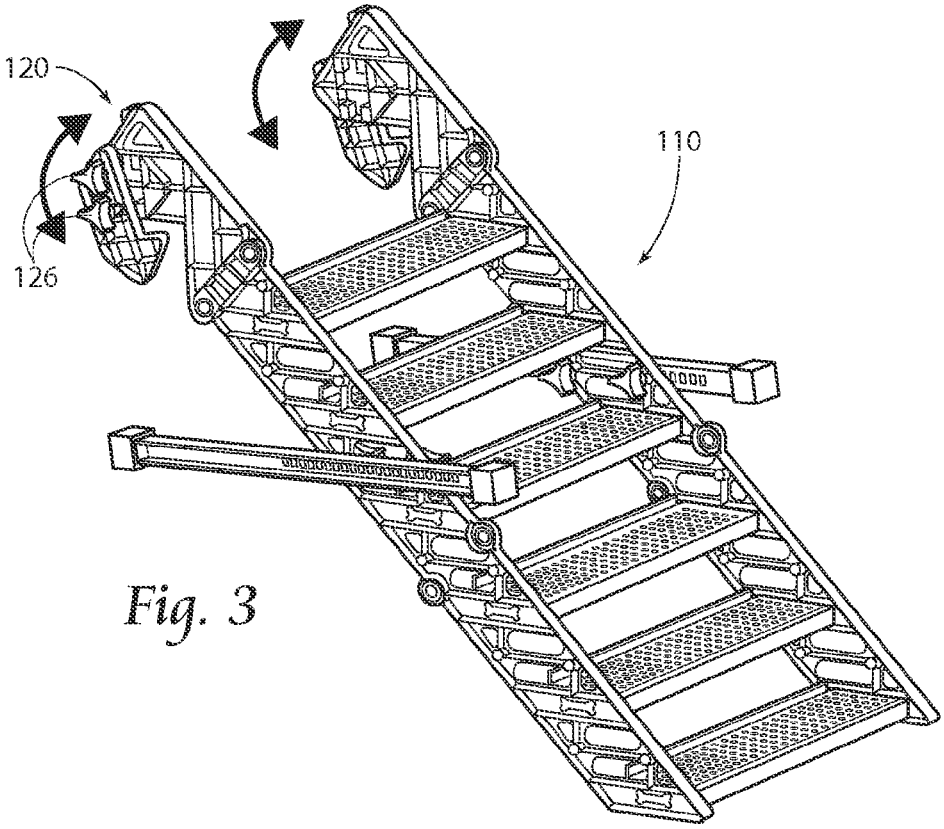
FIG. 3 is a top perspective view of the boarding apparatus demonstrating the rotatability of the mounting assemblies.

Referring again to FIG. 1, the mounting assembly 120 is discussed in further detail. The mounting assembly 120 works in conjunction with the strut assembly 130 to provide a secure and stable arrangement for the apparatus 110. The boat hull mounting assembly 120 comprises retaining hooks 122, mounting brackets 124, and securing mechanisms 126. As shown in FIG. 1, the retaining hooks 122 are attached to the mounting brackets 124 and retained by the securing mechanisms 126. The retaining hooks 122 rotate, as shown in FIG. 3, for ease of attachment of the apparatus 110 to the boat hull lip 180 (depicted in FIG. 5). In the illustrated embodiment, the retaining hook 122 rotation is accomplished with the use of a track located in the hook 122 through which one of the securing mechanisms 126 is located. This relationship allows the hook to rotate about the securing mechanism 126 and allows the hook 122 to be secured in any rotated position. The arrangement allows for the apparatus 110 to be disconnected from the boat hull lip 180 by rotating the retaining hook 122 and releasing it from the lip 180, and repositioned as necessary at other positions on the boat 5. It should be known that any means that allows the hook 122 to be moved and secured in place on a boat hull lip 180 would be within the scope of the present invention. According to the embodiment drawn, this is accomplished with a bolt and wing-nut knob system. The securing means 126 may alternatively be positioned on and manipulated from the outside of the mounting assembly, as shown in FIG. 3. Furthermore, the hook apparatus 122 may be reversed (not shown) such that the backside of the hook 122 is used in a clamping fashion to be secured with the hull lip 180. This may be used as desired, or particularly, when the hook 122 and lip 180 are not of analogous size or configuration, such that the hooks can be used as shown in the Figures. It should also be understood that the hook 122 may encompass any design, shape, or configuration that will provide a positive engagement, such as hooking or clamping, with the boat hull 190.

Figure 4:
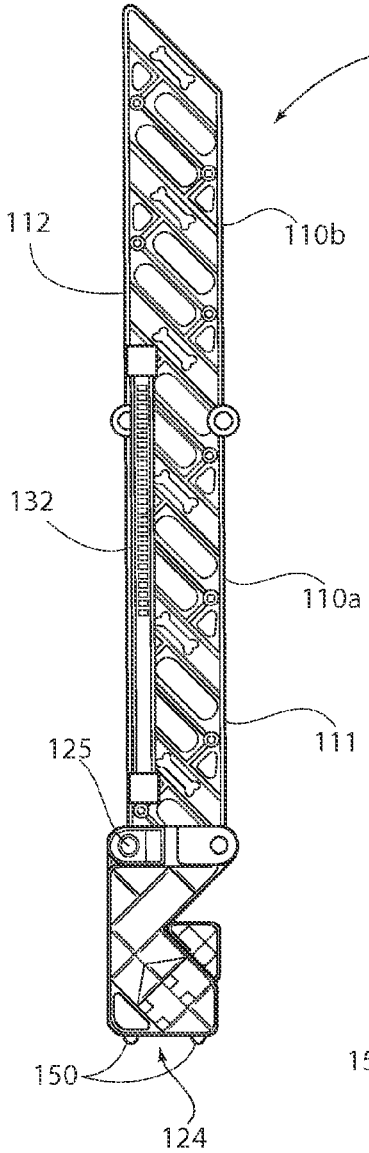
FIG. 4 is a side view of the apparatus of FIG. 1 in a storage configuration.

FIG. 4 shows how the apparatus 110 can be repositioned for storage. The struts 132 may be placed in parallel alignment with the runners 112 and secured in the same fashion as when the struts 132 are used for support. That is, by aligning the holes 138 in the runners 112 with the holes in the struts 132 and securing the struts 132 to their respective runner 112 with the securing mechanisms 134 (not visible in this illustration). Additionally, the retaining hooks 122 may be pivoted inward and closer to the mounting bracket 124, as shown. For purposes of storage, the apparatus 110 may also have a plurality of spaced apart storage feet 150 extending from the terminal end of the mounting bracket 124, which assist with the balance of the apparatus 110 for upright storage.

FIG. 5 depicts another possible feature of the apparatus 110 that allows for the apparatus 110 to be rotated out of the water without disconnecting the apparatus 110 from the boat hull lip 180. The mounting brackets 124 may be attached to the boarding step assembly 111 at a pivot point 125. If, for whatever reason, the boarding steps 111 are no longer needed or wanted in the water, the pivot point 125 allows the user to rotate the boarding step assembly 111 upward and out of the water, as shown.

Figure 6:
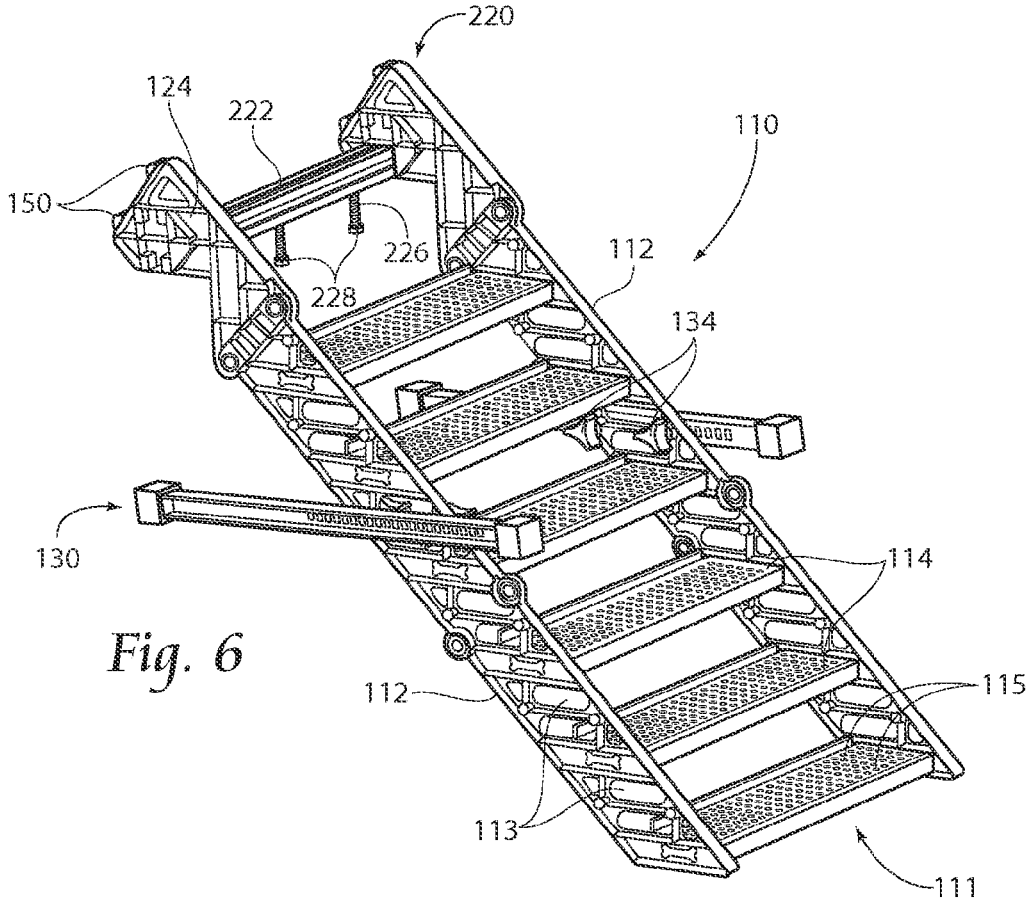
FIG. 6 is a top perspective view of the apparatus incorporating an alternative mounting assembly.

Another embodiment 220 of the mounting assembly is depicted in FIG. 6. The mounting assembly 220 may comprise a mounting bar 222 attached to the mounting brackets 124. The mounting bar may further have at least one securing device 226. The mounting bar 222 may have holes (not shown) in which the securing device 226 interfaces or it may have a track (hidden) with movable retainers (hidden) which interface with the securing device 226 allowing the securing device 226 to be placed anywhere along the mounting bar 222. The securing device 226 may be embodied as a bolt, clamp, slotted sheet of material, or other similar device. As shown, the apparatus 110 would be secured to the boat hull lip 180, or any horizontal surface, by placing the mounting bar 222 on top of the boat hull lip 180 with the securing devices 226 positioned to anchor through the hull lip 180, or any horizontal surface. Upon tightening the securing device 226, such as a pair of bolts as shown, the interfacing side 228 of each bolt 226 abuts the underside of the boat hull lip 180. Further, it should be understood that the mounting bar 222 could be moved to different positions, depending on the particular configuration of the boat and the apparatus 110.

As demonstrated, the apparatus 110 provides for an apparatus and means for an animal to board a boat or other above water surface, from a body of water. The design of the apparatus allows for a secure and stable mounted boarding apparatus, while allowing for the apparatus to be adapted for use on various types of boats and water vessels.

The invention also discloses a method for using the apparatus 110 in conjunction with a boat hull gunwale or transom lip 180, as shown in FIG. 5. The apparatus 110 may be positioned with the mounting brackets 124 in place on the top of the boat hull lip 180. The retaining hooks 122 are rotated inwards so that at least a portion of each retaining hook 122 is underneath the boat hull lip 180, thereby creating a clamping force. The securing mechanisms 126 are then tightened thereby securing the boat hull mounting assembly 120 to the boat hull lip 180. Once the apparatus 110 is in place, the struts 132 may be positioned in a configuration that allows for the preferred boarding step angle. This is done by positioning the struts 132 at a location along the parallel runners 112, adjusting the struts 132 inwardly or outwardly until making contact with the boat hull 190 at the preferred angle, and tightening the securing mechanisms 134 to maintain the position.

Thus, the present invention provides an improved device over the prior art, by allowing multiple positioning of the mounting assembly to accommodate various structures, e.g. boats of difference shapes and designs, docks, floating docks, etc. The mounting assemblies of the present invention are independently adjustable, which contributes to the multiple positioning of the invention. The present invention is also designed to limit damage to the surface that it is being mounted to, but also limit potential damage and wear and tear of the apparatus itself, as it is preferred that the apparatus is generally formed of a material that is non-corrosive, e.g. a plastic material. Such a design will also not deteriorate as other wood or steel based devices may, or absorb water as wood will. In addition, floatation material may be attached to the apparatus to prevent sinking if dropped in the water.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

I claim:

1. A boarding apparatus for boarding animals onto an above-water apparatus, said above-water apparatus having an above-water surface and a body portion having an above-water and a below-water portion, said boarding apparatus comprising:

a hoarding step assembly, having a top end and a bottom end;

said boarding step assembly comprising (a) a pair of spaced-apart, elongated runners, each having a top end and a bottom end, and (b) a plurality of spaced-apart platforms forming a plurality of steps, each of said steps spanning the distance between the elongated runners, said plurality of spaced-apart platforms having an open area between said spaced-apart platforms;

a first mounting assembly, said first mounting assembly configured to grippingly attach said boarding step assembly to at least a portion of said above-water surface, said first mounting assembly comprising (a) at least one mounting bracket positioned at said top of said boarding step assembly, and (b) at least one surface engagement apparatus attached to said at least one mounting bracket, and a second mounting assembly, said second mounting assembly comprising a pair of elongated, adjustable struts configured to stabilize said boarding step assembly against at least a portion of said body, wherein each of said struts are releasably attached to said boarding step assembly by way of a pair of strut securing mechanisms, said strut securing mechanisms affixing each of said struts at the same angle relative to said spaced-apart elongated runners, said strut securing mechanisms preventing said struts from pivoting in relation to said spaced-apart elongated members;

wherein said pair of struts is capable of being moved independently inwardly and outwardly with respect to the boarding step assembly and along the length of said boarding step assembly.

2. The boarding apparatus of claim 1 wherein said surface engagement apparatus comprises at least one retaining hook attached to said at least one mounting bracket.

3. The boarding apparatus of claim 1 wherein the at least one mounting bracket is a pair of mounting brackets.

4. The boarding apparatus of claim 3 wherein said surface engagement apparatus comprises a pair of retaining hooks, wherein each hook is attached to a respective mounting bracket.

5. The boarding apparatus of claim 4 wherein said retaining hooks are releasable attached to said mounting brackets by way of a hook securing mechanism, and wherein said hooks are capable of being rotated relative to said brackets.

6. The boarding, apparatus of claim 5 wherein said hook securing mechanism comprises at least one threaded member capable of extending into and engaging with an aperture on at least one of said retaining hook and said mounting bracket.

7. The boarding apparatus of claim 1 wherein each of said strut securing mechanisms comprise a least one threaded member capable of extending into and engaging with an aperture on at least one of said strut and said hoarding step assembly.

8. The boarding apparatus of claim 1 further comprising a plurality of apertures formed in said boarding step assembly to reduce the surface area of said boarding step assembly.

9. The boarding apparatus of claim 1 wherein said elongated runners further comprise a plurality of apertures formed therein to reduce the surface area of said elongated runners.

10. The boarding apparatus of claim 1 wherein said surface engagement apparatus comprises a mounting bar, said mounting bar attachable to at least a portion of said above-water surface by way of bar securing means.

11. The boarding apparatus of claim 1 wherein said mounting bracket is rotatably coupled to said top end of said boarding step apparatus, thereby allowing said boarding step apparatus to be rotated relative to said mounting bracket.

12. A boarding apparatus for use with a water based structure comprising:

a boarding step assembly;

said boarding step assembly comprising (a) a pair of spaced-apart, elongated runners, each having a top end and a bottom end, and (b) a plurality of spaced-apart platforms forming a plurality of steps, each of said steps spanning the distance between the elongated runners, said plurality of spaced-apart platforms having an open area between said spaced-apart platforms;

a first mounting assembly, said first mounting assembly configured to grippingly attach to said water based structure;

a second mounting assembly, said second mounting assembly comprising two adjustable and removable struts configured to stabilize said boarding step assembly against said water based structure, wherein said struts are capable of being moved independently in the vertical and horizontal directions; and a pair of said securing mechanisms affixing each of said struts at the same angle relative to said spaced-apart elongated runners, said strut securing members preventing said struts from pivoting in relation to said spaced-apart elongated members.

13. A method of boarding an animal onto an above-water surface having a body portion, said body portion having a below-water and an above-water portion, said method comprising the steps of:

providing a boarding apparatus, said apparatus comprising:

a boarding step assembly, having a top end and a bottom end, said boarding step assembly comprises a plurality of apertures formed therein to minimize the surface area of said step assembly;

a first mounting assembly, said first mounting assembly configured to grippingly attach said boarding step assembly to at least a portion of said above-water surface, said first mounting assembly comprising (a) at least one mounting bracket positioned at said top of said boarding step assembly, and (b) at least one surface engagement apparatus attached to said at least one mounting bracket; and a second mounting assembly, said second mounting assembly comprising a pair of elongated, adjustable struts configured to stabilize said hoarding step assembly against at least a portion of said body, wherein at least one strut is releasably attached to said boarding step assembly by way of a pair of strut securing mechanisms;

wherein said struts are capable of being moved horizontally relative to said boarding step assembly and along the length of said hoarding step assembly;

positioning said surface engagement apparatus at at least a portion of said above water surface;

releasably securing said surface engagement apparatus to said surface;

manipulating a first of said struts independently of a second of said struts, in order to stabilize said boarding step assembly; and securing the struts to said boarding step assembly in a fashion wherein the struts are prevented from pivoting and the struts are secured to the boarding step assembly at the same angle with respect to the boarding step assembly.

14. The method of claim 13 wherein said surface engagement apparatus comprises at least one hook, wherein said at least one hook is configured to engage with at least a portion of said above-water surface.

* * * * *